US008106878B2

(12) United States Patent
Huang

(10) Patent No.: US 8,106,878 B2
(45) Date of Patent: Jan. 31, 2012

(54) BACKLIGHT MODULATION CIRCUIT AND METHOD THEREOF

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 775 days.

(21) Appl. No.: 12/218,398

(22) Filed: Jul. 14, 2008

(65) Prior Publication Data

US 2009/0015544 A1 Jan. 15, 2009

(30) Foreign Application Priority Data

Jul. 13, 2007 (CN) ..... 2007 1 0076015

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 5,844,540 | A | 12/1998 | Terasaki | |
| 7,289,098 | B2 | 10/2007 | Ahn | |
| 2003/0043107 | A1 * | 3/2003 | Ruby et al. | 345/102 |
| 2005/0057484 | A1 * | 3/2005 | Diefenbaugh et al. | 345/102 |
| 2007/0091057 | A1 * | 4/2007 | Lee et al. | 345/102 |
| 2007/0268239 | A1 * | 11/2007 | Lin et al. | 345/102 |

FOREIGN PATENT DOCUMENTS

| | | |
|---|---|---|
| CN | 1262982 | 7/2006 |

* cited by examiner

*Primary Examiner* — Chanh Nguyen
*Assistant Examiner* — Roy Rabindranath
(74) *Attorney, Agent, or Firm* — Altis Law Group, Inc.

(57) ABSTRACT

An exemplary backlight modulation circuit (2) includes a first modulation section (220), a second modulation section (221), and a backlight modulation section (240). The first modulation section is configured to generate a first backlight modulation signal. The second modulation section is configured to generate a second backlight modulation signal. The backlight modulation section is configured to modulate illumination of an associated backlight module according to the first and second backlight modulation signals.

17 Claims, 3 Drawing Sheets

BACKLIGHT MODULATION CIRCUIT AND METHOD THEREOF

FIELD OF THE INVENTION

The present invention relates to backlight modulation circuits for liquid crystal displays (LCDs), and particularly to a backlight modulation circuit with coarse and fine modulation functions and a related backlight illumination modulation method.

GENERAL BACKGROUND

A typical LCD has the advantages of portability, low power consumption, and low radiation. LCDs have been widely used in various portable information products such as notebooks, personal digital assistants (PDAs), video cameras and the like. Furthermore, the LCD is considered by many to have the potential to completely replace CRT (cathode ray tube) monitors and televisions.

A conventional LCD typically includes a liquid crystal panel, a backlight module illuminating the LCD panel, and a backlight modulation circuit modulating illumination of the backlight module.

FIG. 5 shows a backlight modulation circuit 1 in an LCD, comprising a signal processing section 120, a signal modulation section 130, and a backlight modulation section 140.

The signal processing section 120 includes an input terminal 121 configured to receive an external command. The signal processing section 120 converts the external command to a backlight modulation signal, and outputs the backlight modulation signal to the signal modulation section 130. After receiving the backlight modulation signal, the signal modulation section 130 modulates a backlight driving signal controlling the illumination of the backlight module, via a pulse width modulation (PWM) or pulse frequency modulation (PFM) method according to the backlight modulation signal. A modulated backlight driving signal is output to the backlight modulation section 140. Accordingly, the backlight modulation section 140 modulates the illumination of the backlight module, thereby achieving an appropriate illumination level for the LCD.

The backlight modulation circuit 1, having only one signal processing channel, can only process one kind of backlight modulation signal at a time, typically a coarse modulation signal or a fine modulation signal. Thus regulating of the illumination of the backlight module by the backlight modulation circuit 1 can only be achieved in one of a large, broad range or a small, precise range at any one time. That is, if illumination of an LCD employing the backlight modulation circuit 1 is to be modulated in both a large range and a precise range, the backlight modulation circuit 1 must modulate the illumination twice via two separate modulation commands. This is inefficient and time-consuming.

It is thus desired to provide a new backlight modulation circuit and a backlight modulation method which can overcome the limitations described.

SUMMARY

In one exemplary embodiment, a backlight modulation circuit includes a first modulation section, a second modulation section, and a backlight modulation section. The first modulation section is configured to generate a first backlight modulation signal. The second modulation section is configured to generate a second backlight modulation signal. The backlight modulation section is configured to modulate illumination of an associated backlight module according to the first and second backlight modulation signals.

Other novel features and advantages of the backlight modulation circuit will become more apparent from the following detailed description when taken in conjunction with the accompanying drawings.

DETAILED DESCRIPTION OF PREFERRED EMBODIMENTS

Reference will now be made to the drawings to describe various embodiments of the present invention in detail.

Figure 1:
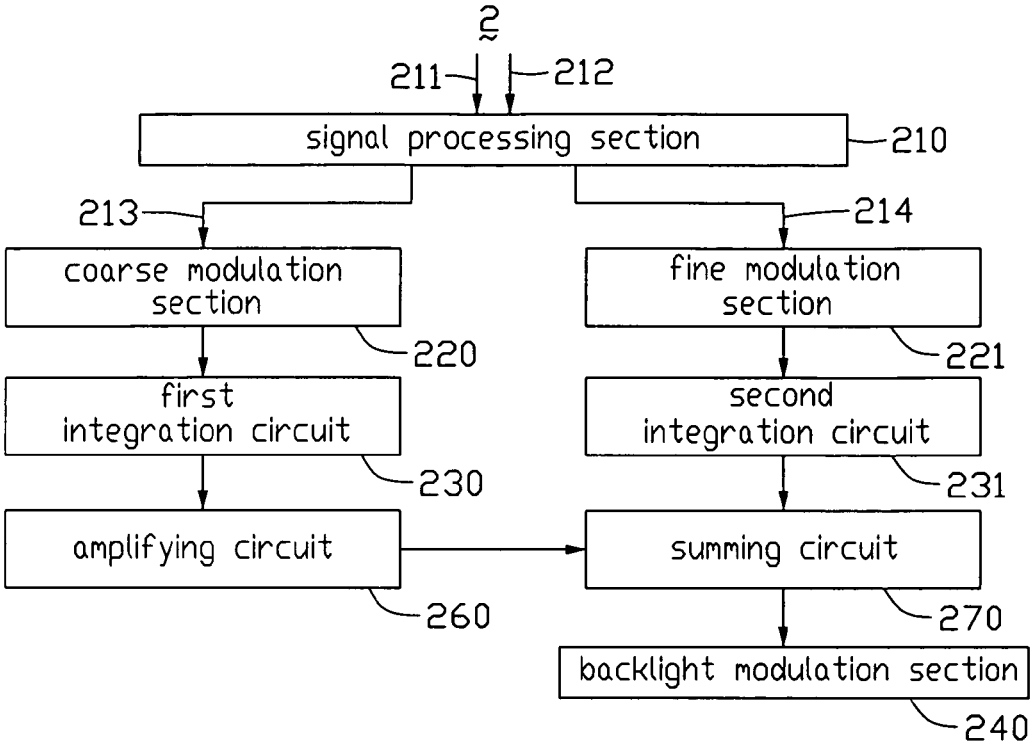
FIG. 1 is a block diagram of a backlight modulation circuit according to a first embodiment of the present invention.

FIG. 1 is a block diagram of a backlight modulation circuit according to a first embodiment of the present invention. The backlight modulation circuit 2 is typically used in an LCD (not shown). The LCD conventionally further includes a liquid crystal panel and a backlight module. The backlight module can include one or more light sources, such as cold cathode fluorescent lamps (CCFLs) or light emitting diodes (LEDs). The backlight modulation circuit 2 includes a signal processing section 210, a coarse modulation section 220, a first integration circuit 230, an amplifying circuit 260, a fine modulation signal generation section 221, a second integration circuit 231, a summing circuit 270, and a backlight modulation section 240.

The signal processing section 210 includes a first input terminal 211, a second input terminal 212, a first output terminal 213, and a second output terminal 214. The first and second input terminals 211, 212 are configured to receive a coarse modulation command and a fine modulation command respectively from an external device (not shown), such as a keyboard, a remote controller, and the like. The first output terminal 213 and the second output terminal 214 are electrically coupled to the coarse modulation section 220 and the fine modulation signal generation section 221, respectively.

The coarse modulation section 220, the first integration circuit 230, and the magnifying circuit 260 are electrically coupled in series in that order. The fine modulation signal generation section 221 and the second integration circuit 231 are electrically coupled in series. Both the amplifying circuit 260 and the second integration circuit 231 are electrically coupled to the summing circuit 270. The summing circuit 270 is electrically coupled to the backlight modulation section 240.

Figure 2:
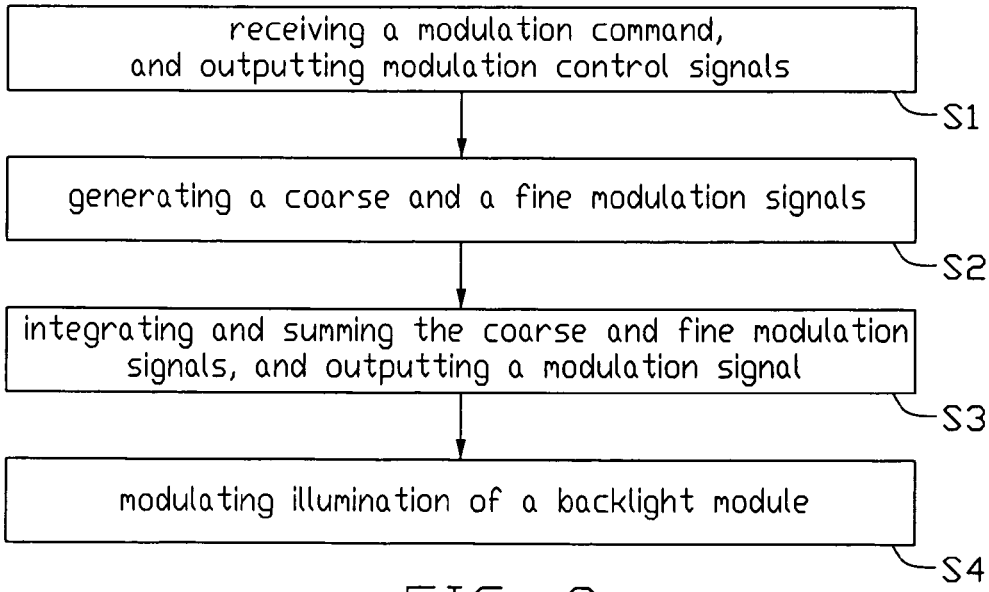
FIG. 2 is a flowchart of a method for modulating illumination of a backlight module according to an exemplary embodiment of the present invention.

FIG. 2 is a flowchart of a method for modulating illumination of a backlight module according to an exemplary embodiment of the present invention. The method includes, in step S1, receiving a modulation command, and outputting modulation control signals, in step S2, generating a coarse and a fine modulation signals, in step S3, integrating and summing the coarse and fine modulation signals and outputting a modulation signal, and, in step S4, modulating illumination of a backlight module.

In step S1, the first and second input terminals 211, 212 receive a coarse modulation command and a fine modulation command respectively from an external device. The coarse modulation command and fine modulation command are processed and converted to a corresponding coarse modulation controlling signal and a corresponding fine modulation controlling signal by the signal processing section 210, respectively. Then the coarse modulation controlling signal and the fine modulation controlling signal are output via the first and second output terminals 213, 214, respectively.

In step S2, the coarse modulation section 220 receives the coarse modulation controlling signal from the first output terminal 213. According to the coarse modulation controlling signal, the coarse modulation section 220 generates and modulates a backlight driving signal using a PWM method, thereby forming a digital coarse modulation signal. The coarse modulation signal, with a relatively large duty ratio, corresponds to a higher illumination of the backlight module; and the coarse modulation signal, with a relatively small duty ratio, corresponds to a lower illumination of the backlight module. After the modulation process, the coarse modulation section 220 analyzes the coarse modulation signal, to determine whether the modulation range of the coarse modulation signal is beyond the modulation range of the backlight module. If the determination is "yes", the illumination of the backlight module is modulated to a maximum value. If the determination is "no", the illumination of the backlight module is modulated in accordance with the coarse modulation signal. Then, the coarse modulation section 220 outputs the coarse modulation signal to the first integration circuit 230.

Simultaneously, the fine modulation signal generation section 221 receives the fine modulation controlling signal from the second output terminal 214. According to the fine modulation controlling signal, the fine modulation section 221 generates and modulates a backlight driving signal also using a PWM method, thereby forming a digital fine modulation signal. The fine modulation signal, with a relatively large duty ratio, corresponds to a higher illumination of the backlight module; and the fine modulation signal, with a relatively small duty ratio, corresponds to a lower illumination of the backlight module. After the modulation process, the fine modulation section 221 analyzes the fine modulation signal, to determine whether the modulation range of the fine modulation signal is beyond a coarse modulation precision, which is the minimum coarse modulation value. If the determination is "yes", the minimum coarse modulation value is subtracted from the fine modulation value, with the result set as a final fine modulation value. If the determination is "no", the fine modulation value is directly set as the final fine modulation value. The fine modulation signal generation section 221 then outputs the fine modulation signal to the second integration circuit 231.

In step S3, the first integration circuit 230 receives and integrates the coarse modulation signal, thereby obtaining an analog coarse modulation signal. The analog coarse modulation signal is then transmitted to the amplifying circuit 260. The amplifying circuit 260 amplifies the analog coarse modulation signal by an appropriate multiple, and the amplified analog coarse modulation signal is transmitted to the summing circuit 270.

Simultaneously, the second integration circuit 231 receives and integrates the fine modulation signal, thereby obtaining an analog fine modulation signal. The analog fine modulation signal is then transmitted to the summing circuit 270.

Then summing circuit 270 adds the fine modulation signal to the coarse modulation signal, and outputs a complex modulation signal having both the coarse and fine modulation signals to the backlight modulation section 240.

In step S4, the backlight modulation section 240 receives the complex modulation signal and modulates the illumination of the backlight module accordingly.

Unlike the conventional backlight modulation circuit, the backlight modulation circuit 2 includes both a coarse modulation section 220 and a fine modulation section 221. The coarse modulation section 220 and the fine modulation section 221 generate coarse and fine modulation signals, respectively. The coarse modulation signal and the fine modulation signal are added together into a complex modulation signal, used by the backlight modulation section 240 to modulate illumination of the backlight module. The complex modulation signal is a combination signal including both coarse and fine modulation information, whereby illumination of the backlight module can be modulated precisely in a short time. Convenience is increased and operating time conserved.

Figure 3:
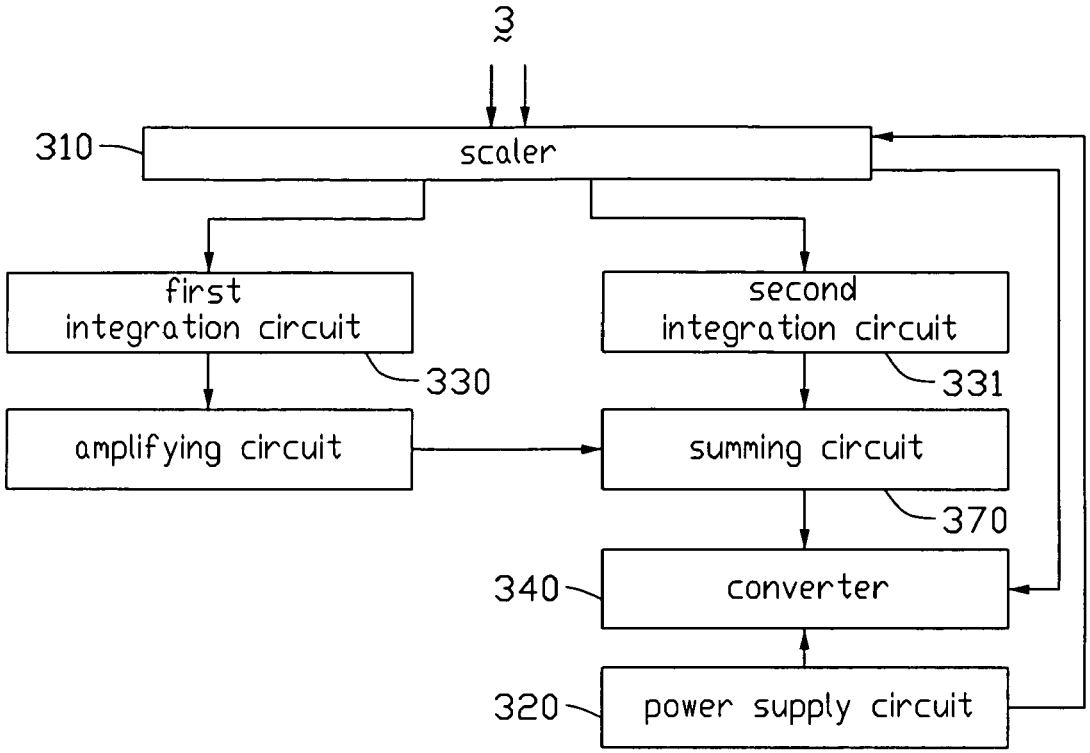
FIG. 3 is a block diagram of a backlight modulation circuit according to a second embodiment of the present invention.

FIG. 3 is a block diagram of a backlight modulation circuit according to a second embodiment of the present invention. The backlight modulation circuit 3 is particularly useful for modulating illumination of CCFLs (not shown), and differs from the backlight modulation circuit 2 shown in FIG. 1 in that the backlight modulation circuit 3 includes a scaler 310, an inverter 340, and a power supply circuit 320. The power supply circuit 320 is configured to provide electrical power to the scaler 310 and the inverter 340. The scaler 310 is an integrated circuit with a signal processing section (not shown), a coarse modulation section (not shown), and a fine modulation signal generation section (not shown) therein, and is able to provide control signals to switch the inverter 340. In operation, the scaler 310 generates a coarse modulation signal and a fine modulation signal which are transmitted to the first integration circuit 330 and the second integration circuit 331, respectively. After being integrated and amplified, an analog coarse modulation signal and an analog fine modulation signal are transmitted to the summing circuit 370. The summing circuit 370 sums the analog coarse modulation signal and the analog fine modulation signal and outputs a complex modulation signal to the inverter 340, which in turn modulates illumination of the CCFLs accordingly.

Figure 4:
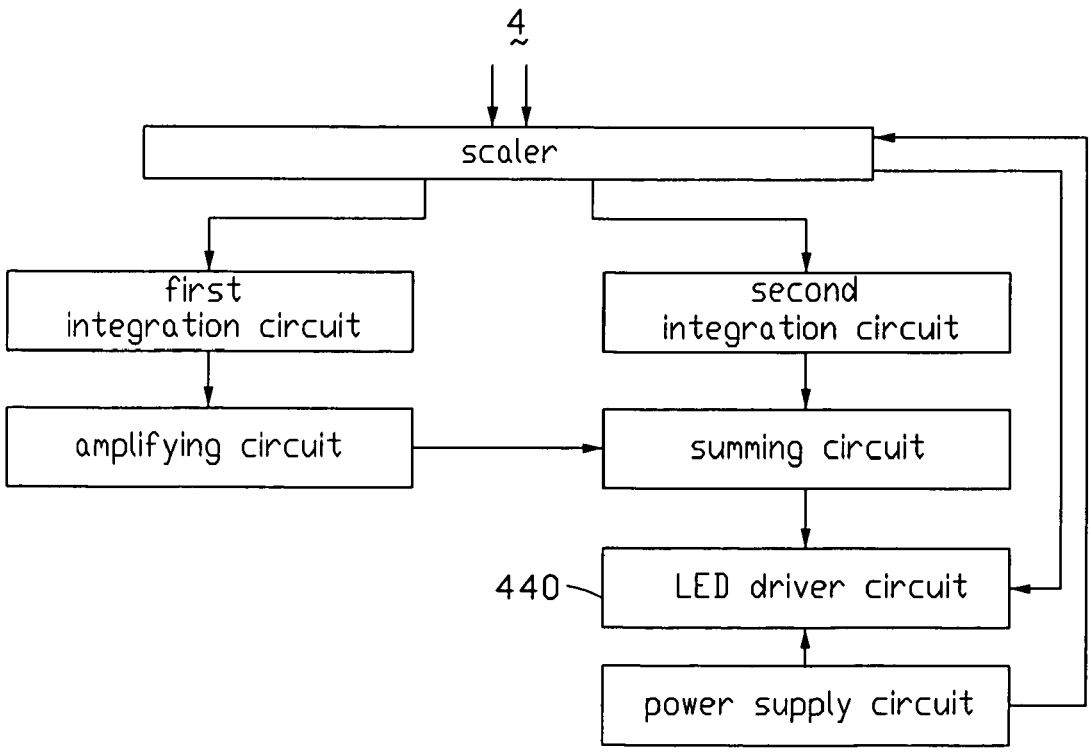
FIG. 4 is a block diagram of a backlight modulation circuit according to a third embodiment of the present invention.
Figure 5:
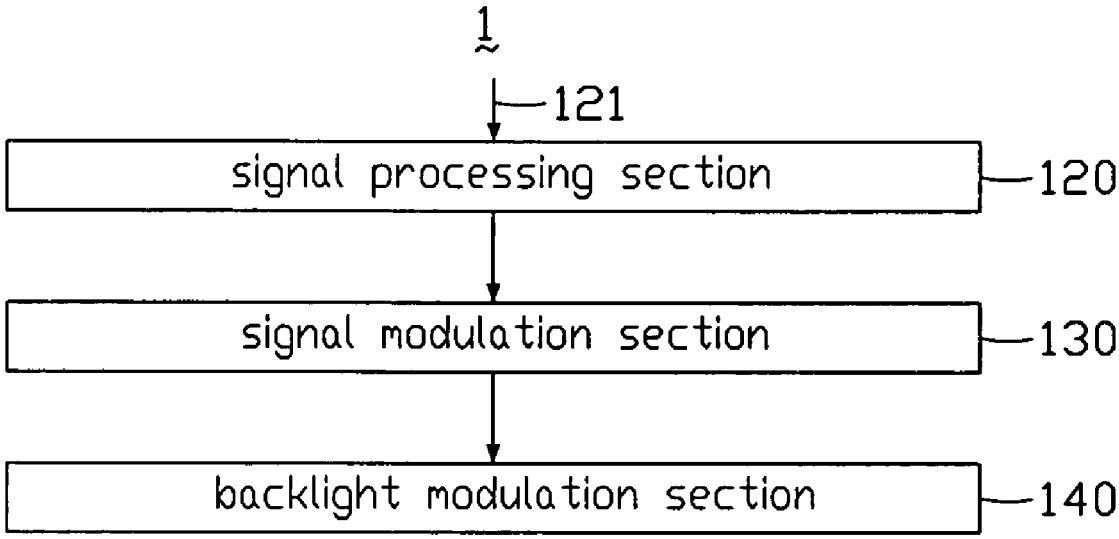
FIG. 5 (RELATED ART)
FIG. 5 is a block diagram of a conventional backlight modulation circuit.

FIG. 4 is a block diagram of a backlight modulation circuit according to a third embodiment of the present invention. The backlight modulation circuit 4 differs from the backlight modulation circuit 3 shown in FIG. 3 only in that an LED driver circuit 440 replaces the inverter 340, to drive LEDs of a backlight module to illuminate.

It is to be understood, however, that even though numerous characteristics and advantages of various embodiments have been set out in the foregoing description, together with details of structures and functions of the embodiments, the disclosure is illustrative only; and that changes may be made in detail, especially in matters of arrangement of parts within the principles of the present invention to the full extent indicated by the broad general meaning of the terms in which the appended claims are expressed.

What is claimed is:

1. A backlight modulation circuit comprising:

a first modulation section configured to generate a first backlight modulation signal;

a second modulation section configured to generate a second backlight modulation signal; and a backlight modulation section configured to modulate illumination of a backlight module according to the first and second backlight modulation signals;

a signal processing section configured to transform external commands into a first and a second controlling signals, the first and second controlling signals being sent to the first and second modulation sections, respectively; and wherein the backlight modulation circuit further comprises a first integration circuit, a second integration circuit, and a summing circuit, the first and second integration circuits carry out integration calculations on the first and second backlight modulation signals respectively and output a first and a second analog backlight modulation signals to the summing circuit, the summing circuit carries out a summing calculation with respect to the first and second analog backlight modulation signals and outputs a complex modulation signal to the backlight modulation section, and the backlight modulation section modulates illumination of the backlight module according to the complex backlight modulation signal.

2. The backlight modulation circuit of claim 1, wherein the first and second modulation sections generate the first and second modulation signals according to the first and second controlling signals, respectively.

3. The backlight modulation circuit of claim 1, further comprising an amplifying circuit, the amplifying circuit amplifying the analog backlight modulation signal from the first integration circuit and outputting an amplified first analog backlight modulation signal to the summing circuit.

4. The backlight modulation circuit of claim 3, wherein the signal processing section and the first and second modulation sections are integrated in a scaler.

5. The backlight modulation circuit of claim 4, further comprising a power supply circuit configured to provide electrical power to the scaler and the backlight modulation section.

6. The backlight modulation circuit of claim 1, wherein the backlight modulation section is an inverter.

7. The backlight modulation circuit of claim 1, wherein the backlight modulation section is a light emitting diode driving circuit.

8. The backlight modulation circuit of claim 1, wherein a minimum modulation range of the first backlight modulation signal exceeds that of the second backlight modulation signal.

9. The backlight module of claim 1, wherein a first integration section analyzes the first controlling signal to determine whether the first backlight modulation signal is beyond a modulation range of the backlight module, and selects a smaller one of the first backlight modulation signal and a maximum value of the modulation range of the backlight module as the first analog backlight modulation signal.

10. The backlight module of claim 1, wherein a second integration section analyzes the second backlight modulation signal to determine whether a modulation range of the second modulation signal is beyond a modulation range of the first integration section, and in response to the modulation range of the second modulation signal is beyond the modulation of the first integration signal, a difference value between a minimum value of the modulation range of the first integration section and the second backlight modulation signal is set as the second analog backlight modulation signal; and in response to the modulation range of the second modulation signal is not beyond the modulation range of the first integration signal, the second backlight modulation signal is set as the second analog backlight modulation signal.

11. A method for modulating illumination of a backlight module including a backlight modulation circuit, the backlight modulation circuit comprising a first modulation section, a second modulation section, and a backlight modulation section, the method comprising steps of:

generating a first backlight modulation signal from the first modulation section;

generating a second backlight modulation signal from the second modulation section;

transforming external commands into a first and a second controlling signals from a signal processing section and sending the first and second controlling signals to the first and second modulation sections, respectively;

carrying out integration calculations for the first and second backlight modulation signals respectively to obtain a first and a second analog backlight modulation signals, and carrying out a summing calculation for the first and second analog backlight modulation signals to obtain a complex modulation signal; and modulating illumination of the backlight module from the backlight modulation section according to the complex modulation signal.

12. The method of claim 11, further comprising the step of generating the first and second modulation signals according to the first and second controlling signals from the first and second modulation sections, respectively.

13. The method of claim 11, further comprising amplifying the first analog backlight modulation signal output from the first integration circuit thereby generating an amplified first analog modulation signal, and transmitting the amplified first analog modulation signal to the summing circuit.

14. The method of claim 13, further comprising the step of providing electrical power for the scaler and the backlight modulation section from a power supply circuit.

15. The method of claim 13, wherein a minimum modulation range of the first backlight modulation signal is greater than that of the second backlight modulation signal.

16. The method of claim 11, wherein the step of carrying out integration calculations for the first and second backlight modulation signals comprises: the first modulation section analyzing the first controlling signal to determine whether the first backlight modulation signal is beyond a modulation range of the backlight module, and selecting a smaller one of the first controlling signal and a maximum value of the modulation range of the backlight module as the first analog backlight modulation signal.

17. The method of claim 11, wherein the step of carrying out integration calculations for the first and second backlight modulation signals comprises the second modulation section analyzing the second backlight modulation signal to determine whether a modulation range of the second modulation signal is beyond a modulation range of the first modulation section, wherein in response to the modulation range of the second modulation signal is beyond the modulation range of the first modulation signal, a difference value between a minimum value of the modulation range of the first modulation section and the second backlight modulation signal is set as the second analog backlight modulation signal; and wherein in response to the modulation range of the second modulation signal is not beyond the modulation range of the first modulation signal, the second backlight modulation signal is set as the second analog backlight modulation signal.

* * * * *